US008734303B2

(12) United States Patent
Huang et al.

(10) Patent No.: US 8,734,303 B2
(45) Date of Patent: May 27, 2014

(54) LIFTABLE AND FOLDABLE TREADMILL

(75) Inventors: Hsuan-Fu Huang, ChangHua County (TW); Shih-Wei Liu, ChangHua County (TW)

(73) Assignee: Dyaco International Inc., Taipei (TW)

( * ) Notice: Subject to any disclaimer, the term of this patent is extended or adjusted under 35 U.S.C. 154(b) by 177 days.

(21) Appl. No.: 13/494,601

(22) Filed: Jun. 12, 2012

(65) Prior Publication Data

US 2013/0237382 A1 Sep. 12, 2013

(30) Foreign Application Priority Data

Mar. 6, 2012 (TW) ..... 101107538 A

(51) Int. Cl.
*A63B 22/02* (2006.01)

(52) U.S. Cl.
USPC ..... 482/54

(58) Field of Classification Search
None
See application file for complete search history.

(56) References Cited

U.S. PATENT DOCUMENTS 6,984,193 B2 * 1/2006 Chen ..... 482/54
7,413,529 B2 * 8/2008 Lee et al. ..... 482/54
2003/0139263 A1 * 7/2003 Wu et al. ..... 482/54
2003/0195088 A1 * 10/2003 Wang et al. ..... 482/54
2005/0164840 A1 * 7/2005 Chen ..... 482/54
2007/0191190 A1 * 8/2007 Kuo ..... 482/54
2008/0004162 A1 * 1/2008 Chen ..... 482/54
2008/0280734 A1 * 11/2008 Dickie et al. ..... 482/54
2008/0312046 A1 * 12/2008 Lin et al. ..... 482/54
2013/0267386 A1 * 10/2013 Her ..... 482/54

FOREIGN PATENT DOCUMENTS

TW M247231 10/2004

* cited by examiner

*Primary Examiner* — Stephen Crow
(74) *Attorney, Agent, or Firm* — Huffman Law Group, P.C.

(57) ABSTRACT

A liftable and foldable treadmill includes a base frame provided with two sliding tracks, a running platform provided at the top side of the base frame, two sliding devices arranged at the front side of the running platform, a lift frame having a front coupling portion pivotally connected to the running platform, a folding frame having a rear coupling portion pivotally connected to the base frame, and a linear brake arranged at the running platform. When folding the running platform, the two sliding tracks are respectively inserted into an upward opening in each of the sliding tracks and moved backwards along the sliding tracks. The linear brake includes an output bar extending downwards and pivotally connected to the lift frame for enabling the front side of the running platform to be lifted. Thus, the lifting and folding mechanisms of the treadmill commonly have a simple structure.

7 Claims, 7 Drawing Sheets

LIFTABLE AND FOLDABLE TREADMILL

BACKGROUND OF THE INVENTION

1. Field of the Invention

The present invention relates to treadmills and more particularly, to a liftable and foldable treadmill that can be lifted to a desired tilting position or folded to a collapsed position.

2. Description of the Related Art

Taiwan Patent Utility M247231 discloses a treadmill in which the running platform is liftable relative to an open frame by a linear brake and a sliding frame set, i.e., the front side of the running platform can be lifted to increase the slope of the running platform. Further, the rear side of the running platform can be lifted to a collapsed erected position, and at the same time, the coupled sliding frame set and a front frame support set can carry two pneumatic cylinders and a support rod to hold the running platform in the collapsed erected position.

The aforesaid running platform lifting mechanism and folding mechanism are complicated. Further, the sliding frame set lifts the running platform by means of stopping against two cushion blocks at the open frame to produce a reaction force. Since the open frame is spaced above the ground at a certain distance, the supporting force provided by the open frame to the running platform is insufficient to protect the running platform from vibration during running of a person on it.

SUMMARY OF THE INVENTION

The present invention has been accomplished under the circumstances in view. It is the main object of the present invention to provide a liftable and foldable treadmill, which utilizes a simple design lifting mechanisms to lift the running platform to a desired tilting position and a simple design of folding mechanism to collapse the running platform.

To achieve this and other objects of the present invention, a liftable and foldable treadmill comprises a base frame, a running platform mounted at the top side of the base frame, two sliding devices respectively bilaterally mounted at the front side of the running platform, a lift frame mounted at the bottom side of the running platform, a folding frame mounted at the bottom side of the running platform, and a linear brake mounted at the running platform. The base frame comprises two opposing inner sides, and two sliding tracks respectively mounted at the two opposing inner sides. Each sliding track defines an upward opening at a front end thereof. The two sliding devices are respectively bilaterally mounted at the front side of the running platform. The lift frame comprises a front coupling portion and a rear coupling portion. The front coupling portion of the lift frame is pivotally connected the running platform. The folding frame comprises at least one front coupling portion and at least one rear coupling portion. The front coupling portion of the folding frame is pivotally connected to the rear coupling portion of the lift frame in such a manner that when the rear side of the running platform is lifted, the two sliding devices are respectively inserted into the upward openings of the sliding tracks and moved backwardly along the sliding tracks, and at the same time, the rear coupling portion of the lift frame and the front coupling portion of the folding frame are carried upwards by the running platform. The linear brake comprises an axially movable output bar extending downwards to the lift frame and pivotally connected to the lift frame in such a manner that when the axially movable output bar is moved from an initial position in direction away from the running platform, the lift frame is turned upwardly about the axis extending through the rear coupling portion thereof from a substantially horizontal position to a tilted position to lift the front side of the running platform.

It is another object of the present invention to provide a liftable and foldable treadmill, which avoids vibration of the running platform when the running platform is being lifted.

To achieve this object, at least one foot member is provided at the bottom side of the folding frame for standing on the ground.

Other advantages and features of the present invention will be fully understood by reference to the following specification in conjunction with the accompanying drawings, in which like reference signs denote like components of structure.

DETAILED DESCRIPTION OF THE INVENTION

Figure 1:
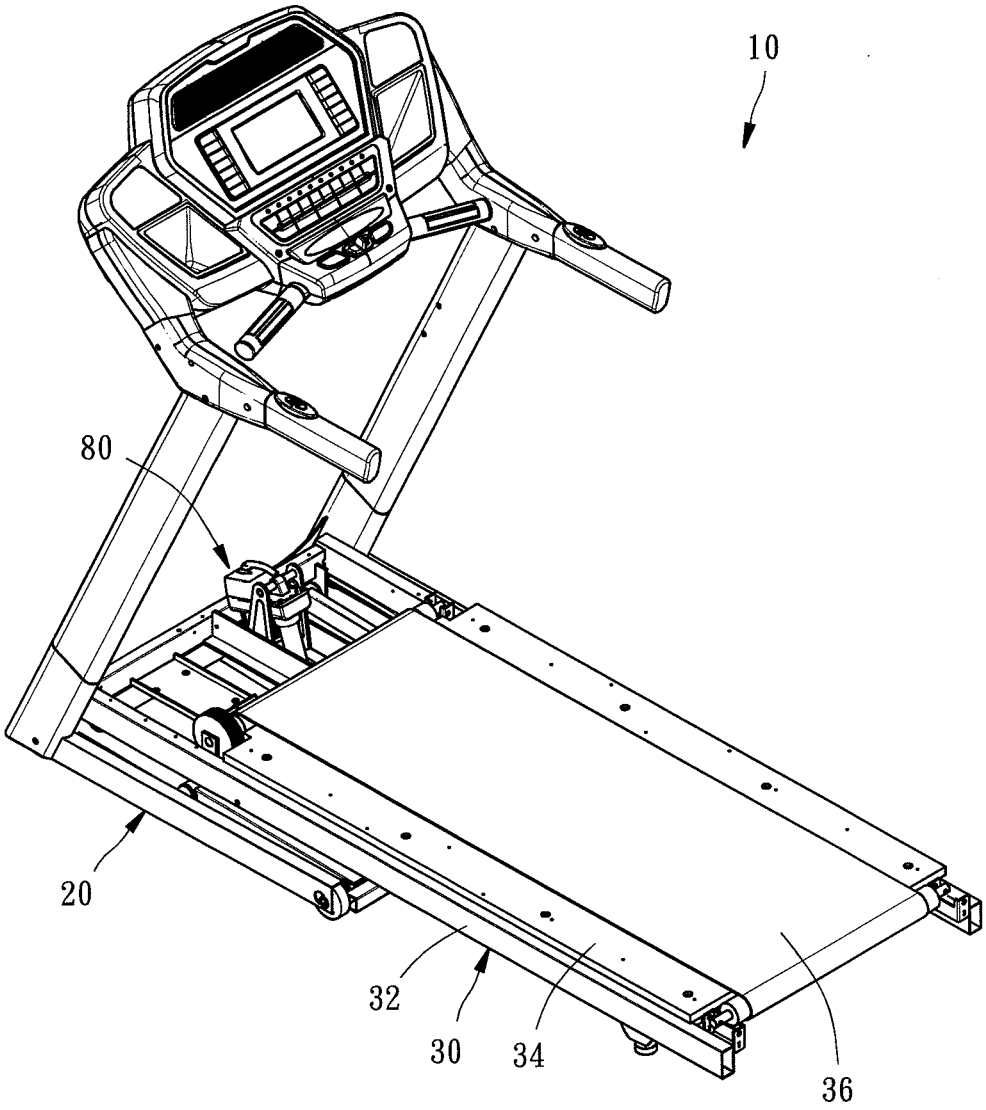
FIG. 1 is an oblique top elevational view of a liftable and foldable treadmill in accordance with the present invention.
Figure 2:
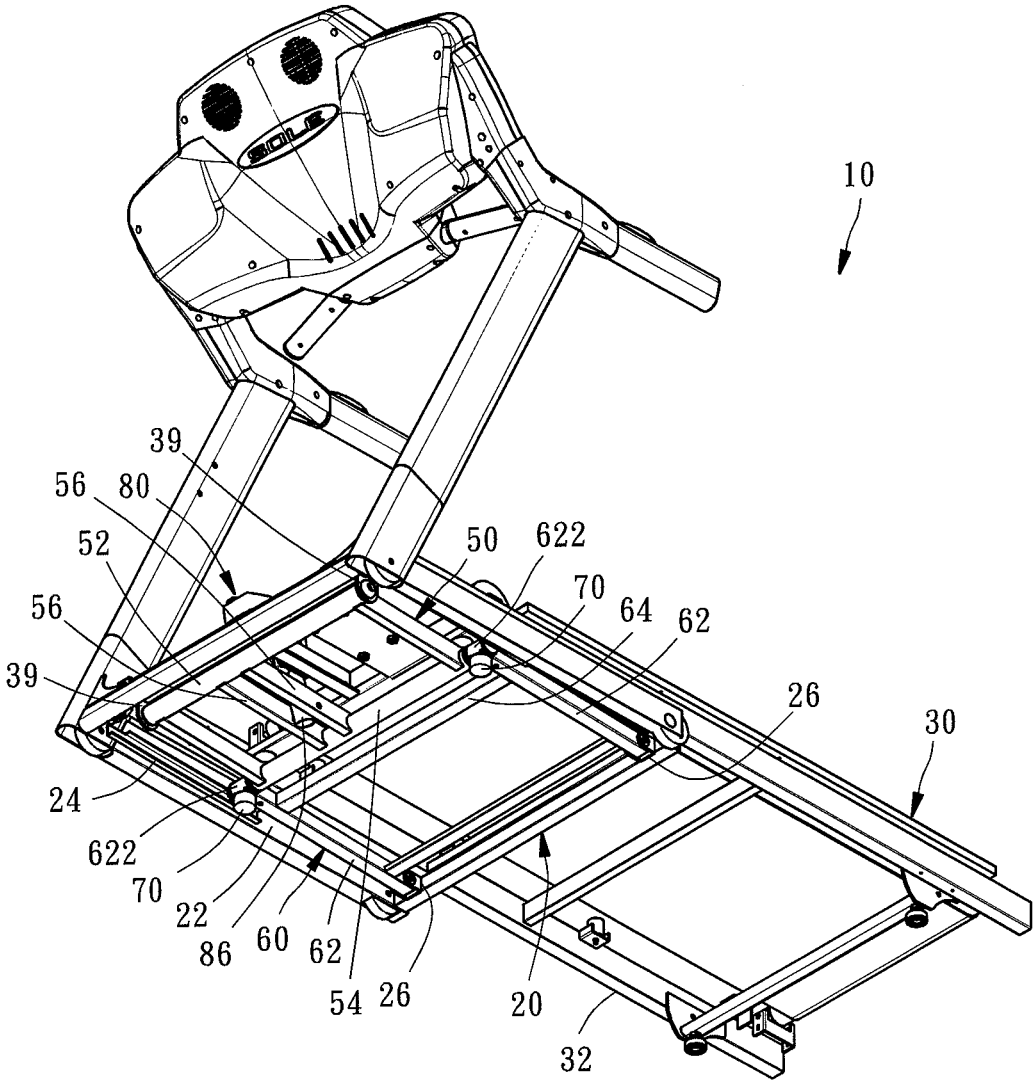
FIG. 2 is an oblique bottom elevational view of the liftable and foldable treadmill in accordance with the present invention.
Figure 3:
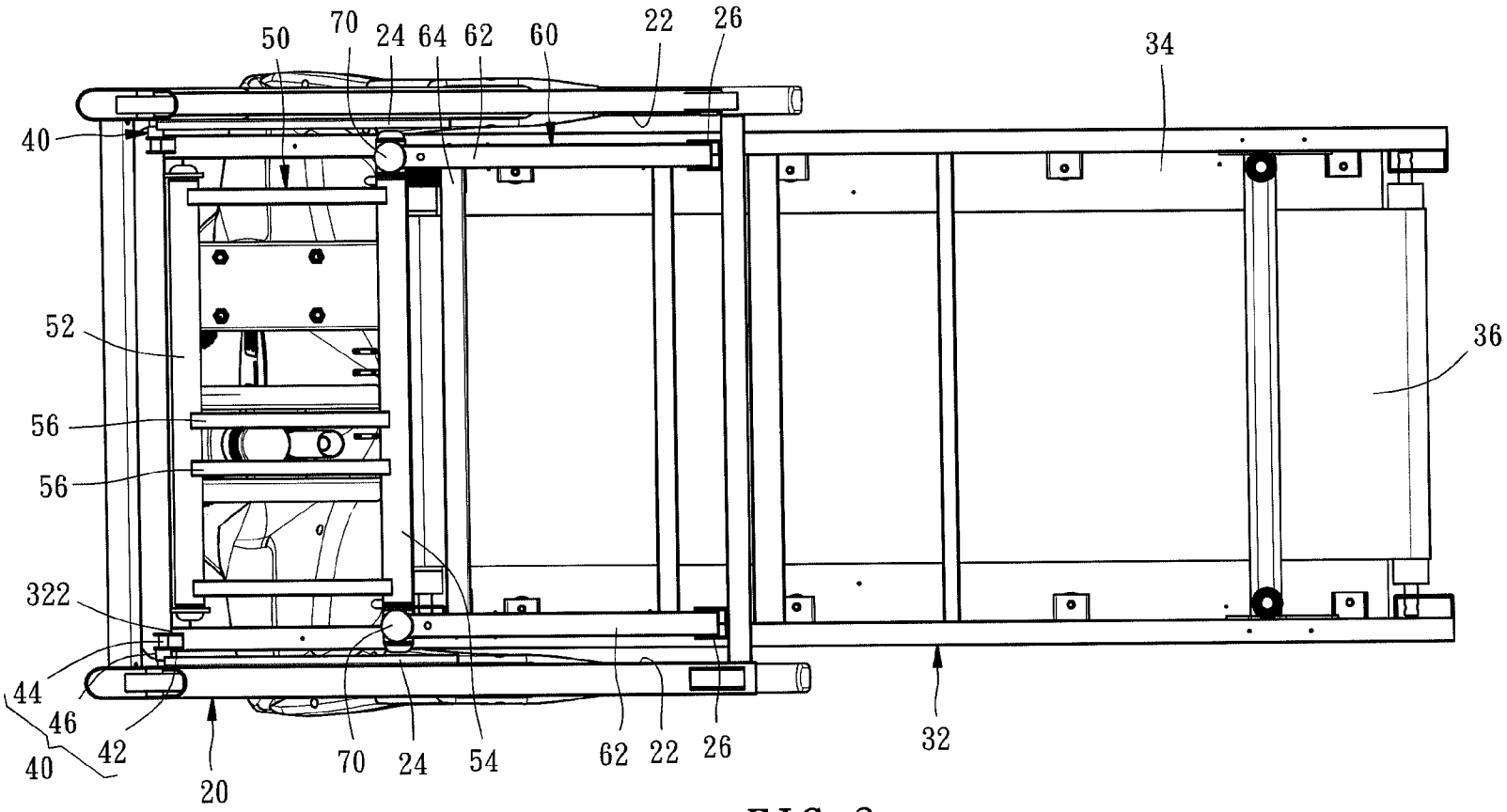
FIG. 3 is a bottom view of the liftable and foldable treadmill in accordance with the present invention.
Figure 4:
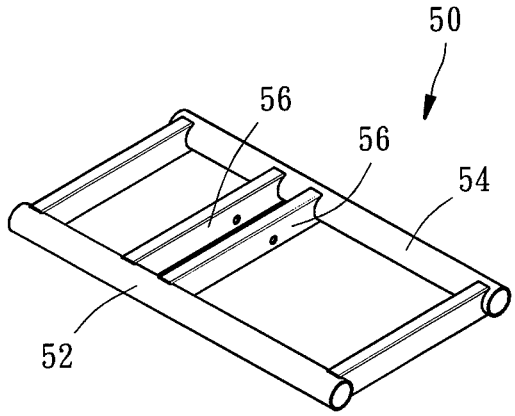
FIG. 4 is an oblique top elevational view of the lift frame of the liftable and foldable treadmill in accordance with the present invention.

Referring to FIGS. 1-5, a liftable and folding collapsible treadmill 10 in accordance with the present invention is shown. The liftable and folding collapsible treadmill 10 comprises a base frame 20, a running platform 30, two sliding devices 40, a lift frame 50, a folding frame 60, two foot members 70, and a linear brake 80.

The base frame 20 comprises two opposing inner sides 22, and two sliding tracks 24 respectively mounted at the two opposing inner sides 22. Each sliding track 24 defines an upward opening 242 at a front end thereof (see FIG. 6).

The running platform 30 is mounted at the top side of the base frame 20, comprising a hollow frame 32, a platform board 34 mounted within the hollow frame 32, and a running belt 36 surrounding and running around the platform board 34.

The sliding devices 40 are respectively bilaterally mounted at the bottom side of the hollow frame 32 of the running platform 30 and disposed at the front side of the running platform 30, i.e. near the front side 322 of the hollow frame 32. Each sliding device 40 comprises a mounting block 42, an axle 44 connected to the mounting block 42, and a sliding component 46 sleeved onto the axle 44.

The lift frame 50 and the folding frame 60 are provided at the bottom side of the running platform 30, as shown in FIG.

Figure 5:
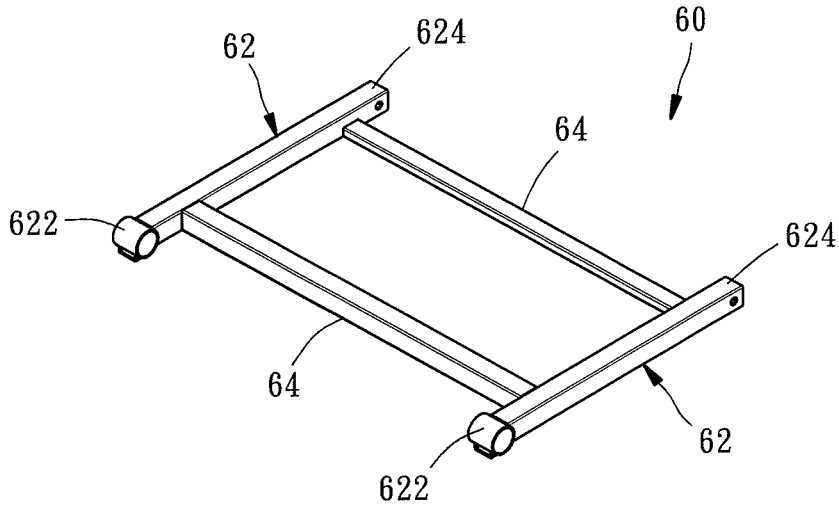
FIG. 5 is an oblique top elevational view of the folding frame of the liftable and foldable treadmill in accordance with the present invention.

4. The lift frame 50 comprises opposing front coupling portion 52 and rear coupling portion 54, and connection bars 56 connected between the front coupling portion 52 and the rear coupling portion 54. The front coupling portion 52 is pivotally connected two lugs 39 at the front side of the running platform 30. As shown in FIG. 5, the folding frame 60 comprises two opposing side bars 62, and two transverse bars 64 connected between the two opposing side bars 62. Each side bar 64 comprises a front coupling portion 622 and a rear coupling portion 624 respectively located on opposing front and rear ends thereof. The front coupling portions 622 of the two opposing side bars 62 are respectively pivotally coupled to the rear coupling portion 54 of the lift frame 50. The rear coupling portion 624 of the two opposing side bars 62 are respectively pivotally coupled to two lugs 26 at the rear side of the base frame 20.

Figure 6:
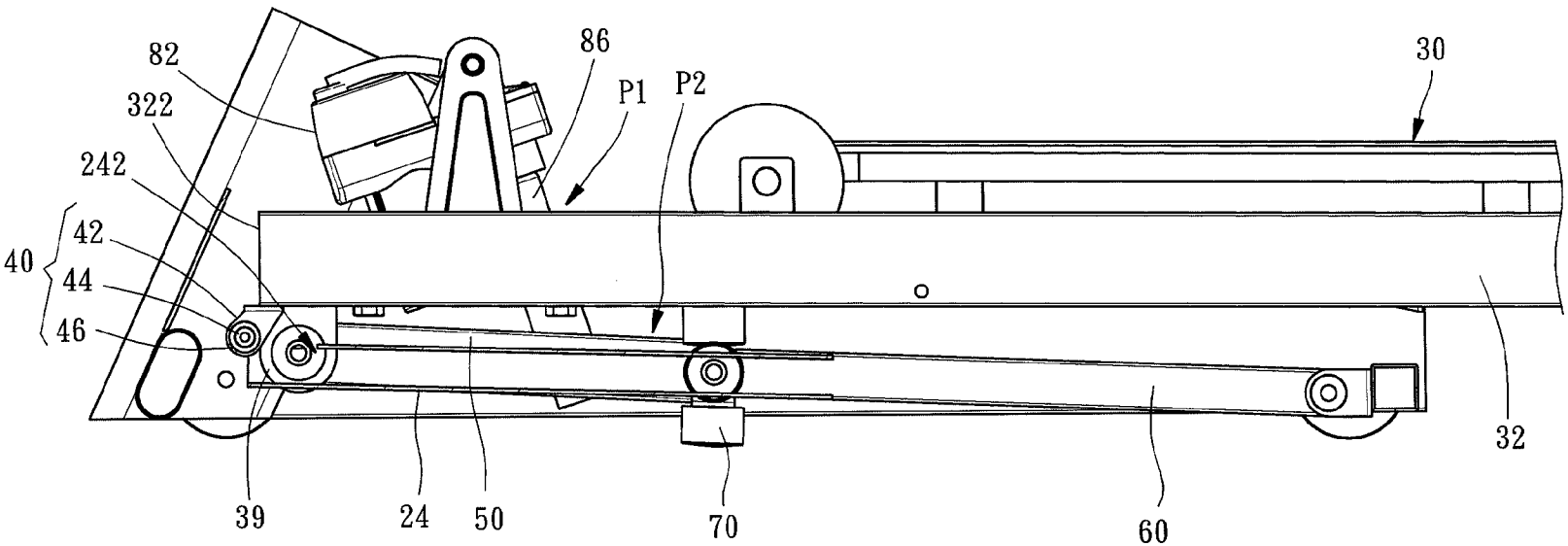
FIG. 6 is a schematic side view of the present invention, illustrating one positioning status of the running platform of the liftable and foldable treadmill in accordance with the present invention.
Figure 7:
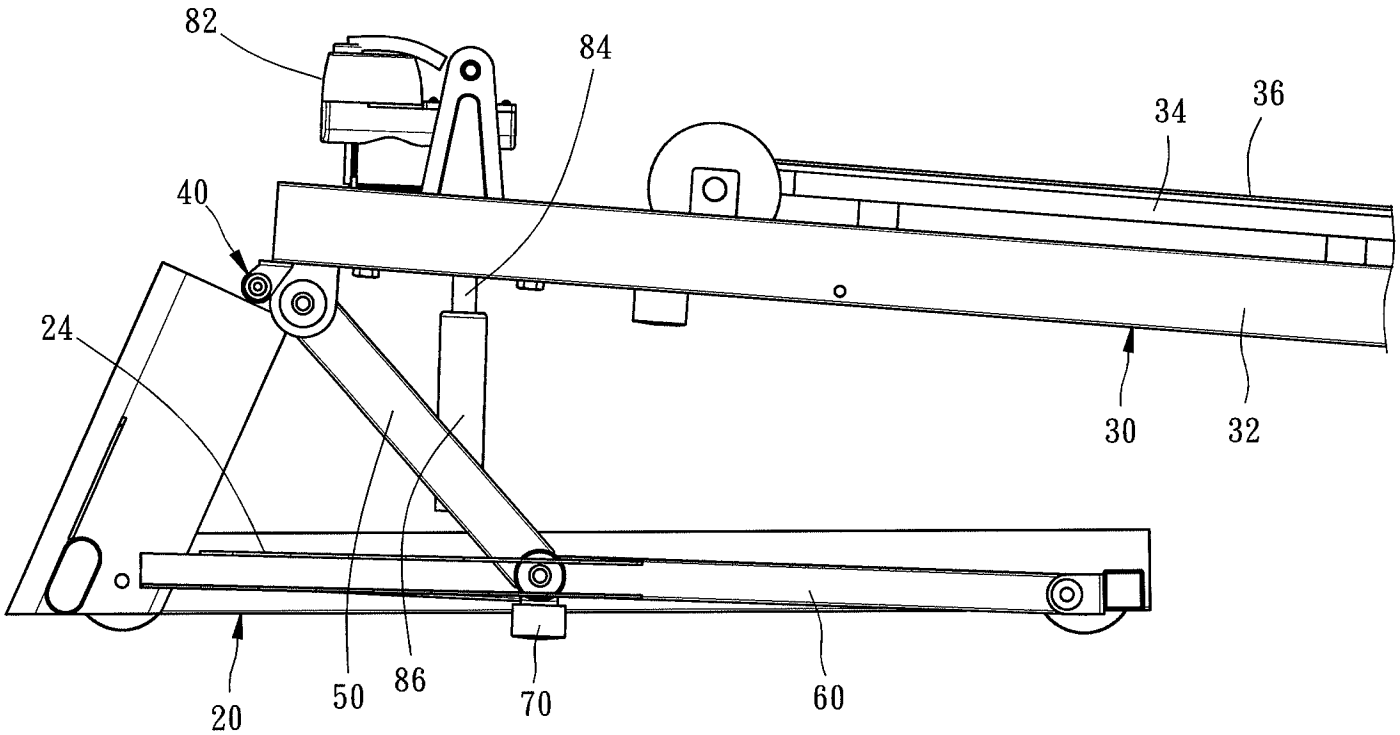
FIG. 7 corresponds to FIG. 6, illustrating the tilting angle of the running platform adjusted.

The two foot members 70 are shock absorbing rubber pads respectively fixedly mounted at the two opposing side bars 62 of the folding frame 60 at the bottom side and respectively disposed adjacent to the front coupling portions 622. As shown in FIG. 6 and FIG. 7, when the running platform 30 is set in an operation condition, the two foot members 70 are stopped at the ground.

As shown in FIG. 7, the linear brake 80 comprises a motor 82 mounted at the hollow frame 32 of the running platform 30, a screw rod 84 coupled to and rotatable by the motor 82, and an internally threaded output tubular bar 86 threaded onto the screw rod 84. As shown in FIG. 6 and FIG. 7, the internally threaded output tubular bar 86 extends downwardly to the lift frame 50 and is pivotally coupled to the connection bars 56 of the lift frame 50. When the internally threaded output tubular bar 86 is driven by the motor 82 and the screw rod 84 to move from an initial position P1 in direction away from the running platform 30, the internally threaded output tubular bar 86 imparts a pressure to the lift frame 50, the folding frame 60 and the foot members 70 against the ground, thus a reaction force is produced to turn the lift frame 50 about the axis extending through the rear coupling portion 54 from a substantially horizontal position P2 to a tilted position, thereby increasing the slope of the running platform 30. On the contrary, when the internally threaded output tubular bar 86 is driven by the motor 82 and the screw rod 84 to move in direction toward the running platform 30, the front side of the running platform 30 will be lowered, thereby reducing the slope.

Figure 8:
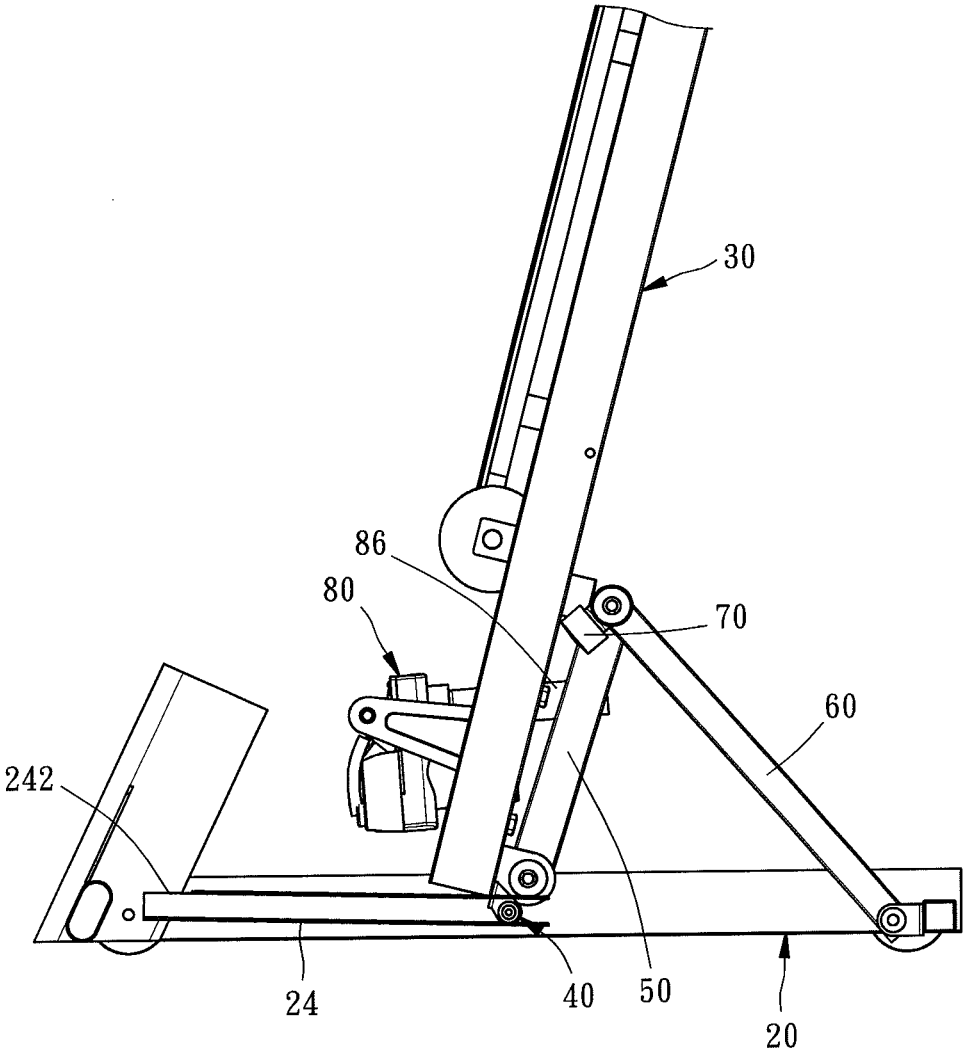
FIG. 8 is a schematic side view of the present invention, illustrating the running platform of the liftable and foldable treadmill set in the erected collapsed position.

Referring to FIG. 8, when the liftable and folding collapsible treadmill 10 is not to be used temporarily, the user can lift the rear side of the running platform 30. At this time, the sliding components 46 of the sliding devices 40 are respectively inserted into the upward openings 242 of the sliding tracks 24 of the base frame 20 and moved backwardly along the sliding tracks 24, and at the same time, the rear coupling portion 54 of the lift frame 50 and the front coupling portions 622 of the folding frame 60 are moved upwardly with the running platform 30. When running platform 30 is biased upwardly to a predetermined angle, a pneumatic cylinder and a retractable bar (not shown) between the transverse bars 64 of the folding frame 60 and the hollow frame 32 of the running platform 30 support the running platform 30 in the adjusted position. Since this part is of the known technique, no further detailed description in this regard is necessary.

Further, the center of each sliding device 40 protrudes over the front side 322 of the hollow frame 32, facilitating folding the running platform 30. However, it is to be noted that the aforesaid sliding device 40 mounting location is not a limitation.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A liftable and foldable treadmill, comprising:

a base frame comprising two opposing inner sides, and two sliding tracks respectively mounted at said two opposing inner sides, each said sliding track defining an upward opening at a front end thereof;

a running platform mounted at a top side of said base frame, said running platform comprising a front side and a rear side opposite to the front side;

two sliding devices respectively bilaterally mounted at the front side of said running platform;

a lift frame mounted at a bottom side of said running platform, said lift frame comprising a front coupling portion and a rear coupling portion, said front coupling portion being pivotally connected said running platform;

a folding frame mounted at a bottom side of said running platform, said folding frame comprising at least one front coupling portion and at least one rear coupling portion, the front coupling portion of said folding frame being pivotally connected to the rear coupling portion of said lift frame in such a manner that when the rear side of said running platform is lifted, said two sliding devices are respectively inserted into the upward openings of said sliding tracks and moved backwardly along said sliding tracks, and at the same time, the rear coupling portion of said lift frame and the front coupling portion of said folding frame are carried upwards by said running platform; and a linear brake mounted at said running platform, said linear brake comprising an axially movable output bar extending downwards to said lift frame and pivotally connected to said lift frame in such a manner that when said axially movable output bar is moved from an initial position in direction away from said running platform, said lift frame is turned upwardly about the axis extending through the rear coupling portion thereof from a substantially horizontal position to a tilted position to lift the front side of said running platform.

2. The liftable and foldable treadmill as claimed in claim 1, wherein said folding frame comprises at least one foot member located on a bottom side thereof for standing on the ground.

3. The liftable and foldable treadmill as claimed in claim 2, wherein said folding frame comprises two front coupling portions, and two foot members respectively disposed adjacent to the two front coupling portions.

4. The liftable and foldable treadmill as claimed in claim 3, wherein said folding frame further comprises two opposing side bars; the two front coupling portions of said folding frame are respectively located on said side bars at a front side thereof; said folding frame comprises two rear coupling portions respectively located on said side bars at a rear side thereof.

5. The liftable and foldable treadmill as claimed in claim 4, wherein each said sliding device has the center thereof protruding over the front side of said running platform.

6. The liftable and foldable treadmill as claimed in claim 5, wherein said lift frame further comprises at least one connection bar connected between the front coupling portion and rear coupling portion thereof; said axially movable output bar of said linear brake is pivotally connected to said at least one connection bar.

7. The liftable and foldable treadmill as claimed in claim 1, wherein said lift frame further comprises at least one connection bar connected between the front coupling portion and rear coupling portion thereof; said axially movable output bar of said linear brake is pivotally connected to said at least one connection bar.

* * * * *